US008905577B2

(12) United States Patent
Meurer et al.

(10) Patent No.: US 8,905,577 B2
(45) Date of Patent: Dec. 9, 2014

(54) LAMP HOUSING WITH CLAMPING LENS

(76) Inventors: William Henry Meurer, Pasadena, CA (US); Stan Levy, Arcadia, CA (US)

( * ) Notice: Subject to any disclaimer, the term of this patent is extended or adjusted under 35 U.S.C. 154(b) by 0 days.

(21) Appl. No.: 13/075,467

(22) Filed: Mar. 30, 2011

(65) Prior Publication Data

US 2011/0176298 A1 Jul. 21, 2011

Related U.S. Application Data

(63) Continuation-in-part of application No. 12/378,413, filed on Feb. 12, 2009, now Pat. No. 7,997,770.

(51) Int. Cl.

| | |
|---|---|
| ***F21V 29/00*** | (2006.01) |
| ***F21S 4/00*** | (2006.01) |
| ***F21K 99/00*** | (2010.01) |
| *F21Y 103/00* | (2006.01) |
| *F21V 19/00* | (2006.01) |

(52) U.S. Cl.

CPC . *F21V 29/22* (2013.01); *F21K 9/00* (2013.01); *F21V 29/004* (2013.01); *F21K 9/17* (2013.01); *F21V 29/24* (2013.01); *F21Y 2103/003* (2013.01); *F21V 19/0035* (2013.01); *F21V 29/246* (2013.01)

USPC ..... 362/240; 362/219; 362/225; 362/249.02; 362/249.06

(58) Field of Classification Search

USPC ..... 362/218, 219, 225, 236, 240, 244, 362/249.02, 249.06, 249.14; 174/252, 266

See application file for complete search history.

(56) References Cited

U.S. PATENT DOCUMENTS

| | | | | |
|---|---|---|---|---|
| 3,301,939 | A * | 1/1967 | Bert | 174/266 |
| RE29,784 | E * | 9/1978 | Chadwick et al. | 174/252 |
| 4,495,378 | A * | 1/1985 | Dotzer et al. | 174/252 |
| 4,628,421 | A * | 12/1986 | Saar | 362/238 |
| 4,858,087 | A * | 8/1989 | Hartshorn | 362/219 |
| 6,472,823 | B2 * | 10/2002 | Yen | 315/112 |
| 6,641,284 | B2 * | 11/2003 | Stopa et al. | 362/240 |
| 6,871,981 | B2 * | 3/2005 | Alexanderson et al. | 362/294 |
| 7,144,129 | B2 * | 12/2006 | Mackin | 362/223 |
| 7,307,391 | B2 * | 12/2007 | Shan | 315/291 |
| 7,331,689 | B2 * | 2/2008 | Chen | 362/240 |
| 7,572,027 | B2 * | 8/2009 | Zampini et al. | 362/225 |
| 7,674,010 | B2 * | 3/2010 | Griffiths et al. | 362/249.02 |
| 7,758,207 | B1 * | 7/2010 | Zhou et al. | 362/218 |
| 7,766,510 | B2 * | 8/2010 | Lee | 362/249.02 |
| 7,815,338 | B2 * | 10/2010 | Siemiet et al. | 362/218 |
| 7,976,196 | B2 * | 7/2011 | Ivey et al. | 362/294 |
| 8,047,674 | B2 * | 11/2011 | Liu | 362/218 |
| 8,167,466 | B2 * | 5/2012 | Liu | 362/373 |

(Continued)

*Primary Examiner* — Ismael Negron

(74) *Attorney, Agent, or Firm* — Gene Scott; Patent Law & Venture Group

(57) ABSTRACT

A lamp housing uses a tubular metal support functional as a heat radiator within which is an electrical circuit board having a component mounting surface, and in opposition thereto, a thermal transfer surface positioned for conducting heat, from the circuit board to the metal support. A clear lens is secured to the metal support, and a pair of ribs integral to the clear lens extend into contact with the component mounting surface of the circuit board thereby urging the thermal transfer surface toward the metal support for good thermal contact and heat transfer. A thermal transfer tape or paste may be used between the circuit board and the metal support surface upon which it rests. The circuit board may be laid onto the metal support without sliding it into grooves and the clear lens may be snapped into place over the circuit board engaging grooves in the metal support.

4 Claims, 3 Drawing Sheets

(56) References Cited

U.S. PATENT DOCUMENTS

| | | | | |
|---|---|---|---|---|
| 8,220,977 | B2 * | 7/2012 | Fugerer et al. | 362/373 |
| 8,313,213 | B2 * | 11/2012 | Lin et al. | 362/225 |
| 8,382,314 | B2 * | 2/2013 | Ou et al. | 362/217.02 |
| 2009/0185379 | A1 * | 7/2009 | Chen | 362/294 |
| 2009/0296381 | A1 * | 12/2009 | Dubord | 362/218 |
| 2010/0033964 | A1 * | 2/2010 | Choi et al. | 362/234 |
| 2010/0220476 | A1 * | 9/2010 | Kuo et al. | 362/235 |

* cited by examiner

LAMP HOUSING WITH CLAMPING LENS

CROSS-REFERENCE TO RELATED APPLICATIONS

This is a Continuation-In-Part application of U.S. patent application Ser. No. 12/378,413, filed Feb. 12, 2009, now U.S. Pat. No. 7,997,770 which is incorporated herein in its entirety by reference.

BACKGROUND

The present disclosure relates to the field of lighting devices and particularly to the type of lighting devices represented by fluorescent tube. Prior filed application to Sun et al, publication US 2008/0158870 represents a new direction in such lighting whereby LED components are used as in the following disclosure. Chen, US 2008/0037245 and Timmermaus et al, US 2002/0060526 and Robertson, U.S. Pat. No. 7,478,924 are also examples of this new type of device. Key to the successful operation of these devices is the dissipation of heat which is achieved by thermal sinking to a metallic radiator, so that the ability to conduct heat from the lighting components to the metal radiator is critical.

SUMMARY

In the present disclosure, a lamp housing uses a tubular metal support functional as a heat radiator on which is mounted an electrical circuit board having a component mounting surface, and a thermal transfer surface positioned for conducting heat from the circuit board to the metal support. A clear lens is secured to the metal support, and positioned over the circuit board, and a pair of ribs integral to the clear lens extend into contact with the component mounting surface of the circuit board thereby pressing the thermal transfer surface against the metal support for good thermal contact and heat transfer. A thermal transfer tape or paste may be used between the circuit board and the metal support surface upon which it rests. The circuit board is able to be laid directly onto the metal support without sliding it into grooves and the clear lens may be snapped into place over the circuit board.

In one aspect of the present apparatus, the clear lens is able to be mounted and dismounted from the metal support by snap-action due to the elastic flexibility of the lens.

In another aspect of the apparatus, the circuit board is inserted or removed from the metal support by simple placement and displacement without sliding or other movements which may be a problem when a thermal tape is applied between the board and the support.

In another aspect of the apparatus, the circuit board may mount the lamp's pin-outs directly to the circuit board and provide holes in the end caps for the pins to protrude through so as to enable end cap removal without interconnections with the pin-outs.

In another aspect of the apparatus, the lens cover provides clamping action against the circuit board for improved thermal transfer from the board to the metal surface of the support.

In another aspect of the apparatus, thermal surfaces are etched on both sides of the circuit board and are thermally joined by a cluster of plated through holes for improved thermal dissipation from electrical components mounted on the board.

These and other aspects may, in various implementations, provide novel and non-obvious advantages over the prior art.

The details of one or more embodiments of these concepts are set forth in the accompanying drawings and the description below. Other features, objects, and advantages of these concepts will be apparent from the description and drawings, and from the claims.

DESCRIPTION OF DRAWINGS

Like reference symbols in the various drawings indicate like elements.

DETAILED DESCRIPTION

Figure 1:
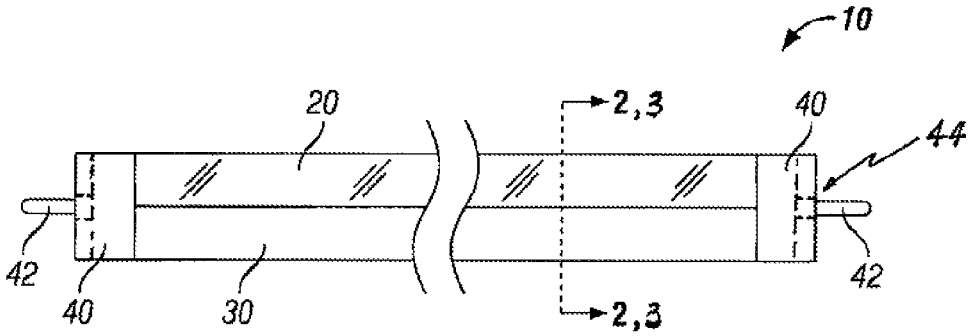
FIG. 1 is a side elevational view of an example of the presently described apparatus.

FIG. 1 illustrates a side elevational view of the presently described apparatus, a lamp housing and operating lamp 10. A clear lens 20 covers a metal support 30 and end caps 40 are mounted on the ends of the lamp 10. As shown, electrodes 42 extend away from the lamp 10 in opposite directions.

Figure 2:
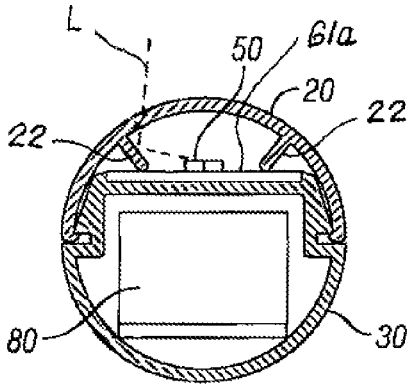
FIG. 2 is a sectional view thereof taken along line 2-2.

FIG. 2 is a cross-section of lamp 10 taken at 2-2 and illustrates the interior construction. An electrical circuit board 61 has a component mounting surface 61*a* shown in FIG. 5, and in opposition thereto, a thermal transfer surface 61*b* shown in FIG. 4, the thermal transfer surface 61*b* positioned, as shown in FIG. 2 for directing heat, by conduction, from the circuit board 61 to the metal support 30.

The clear lens 20 is secured to the metal support 30 and a pair of ribs 22 (FIG. 3) are integral to the clear lens 20, and are in contact with the component mounting surface 61*a* of the circuit board 61 thereby urging the thermal transfer surface 61*b* toward the metal support 30.

As shown in FIG. 1, the metal support 30 and the clear lens 20 may both be elongate, but other configurations are possible, such as circular, arcuate and rectangular. In the example shown in FIGS. 2 and 3, the metal support 30 is tubular but other configurations are possible as would be realized by a routine equipment designer.

Figure 5:
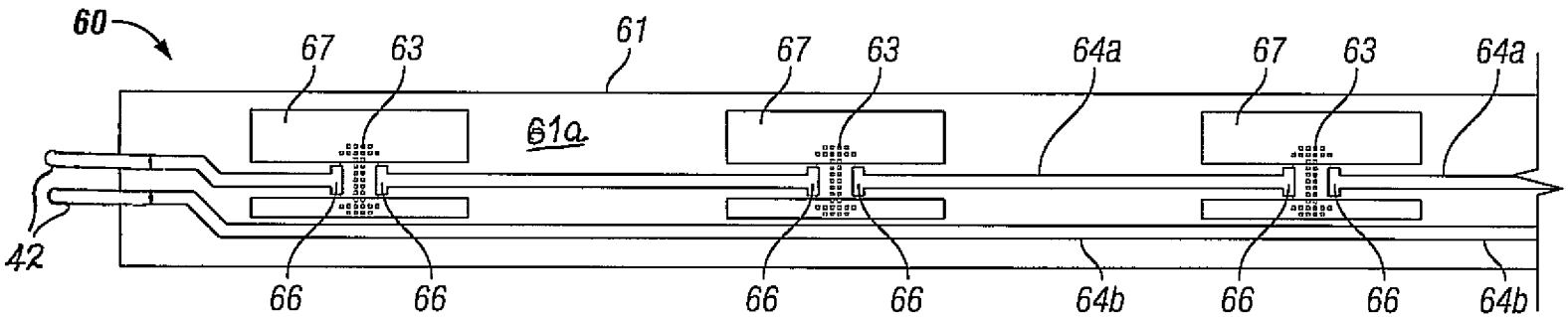
Figure 6:
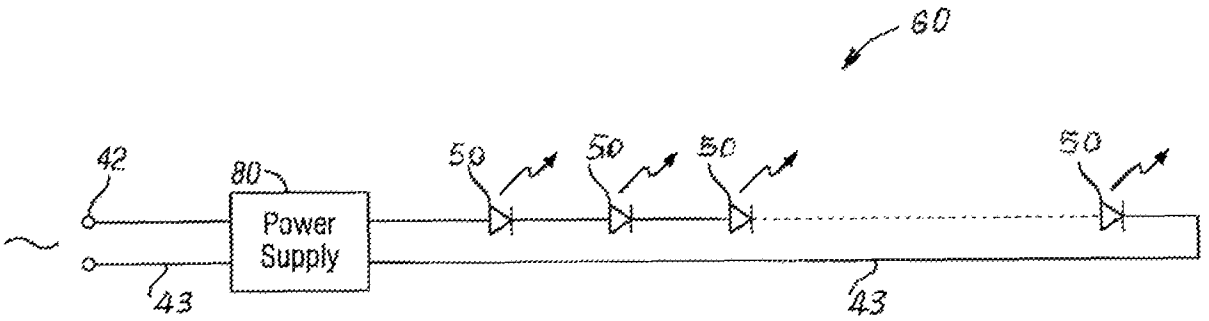
FIG. 6 is an electrical schematic diagram of an example electrical circuit thereof.

As shown in FIG. 6, the operating lamp 10 has an electrical circuit which includes electrodes 42, power supply 80 components 68 and electrical conductors which interconnect these elements. As shown in FIG. 5, conductive etched copper traces 64*a* and 64*b* may be used to interconnect components on the circuit board 61. The traces 64*a* and 64*b* may be interconnected with electrodes 42 for interconnecting the electrical circuit 60 with an external power source, for instance a source of alternating current. The end caps 40 may have apertures 44 (FIG. 1) in them allowing the electrodes 42 to extend through caps 40 while allowing the end caps 40 to be removed without interfering with the electrical circuit 60.

Figure 3:
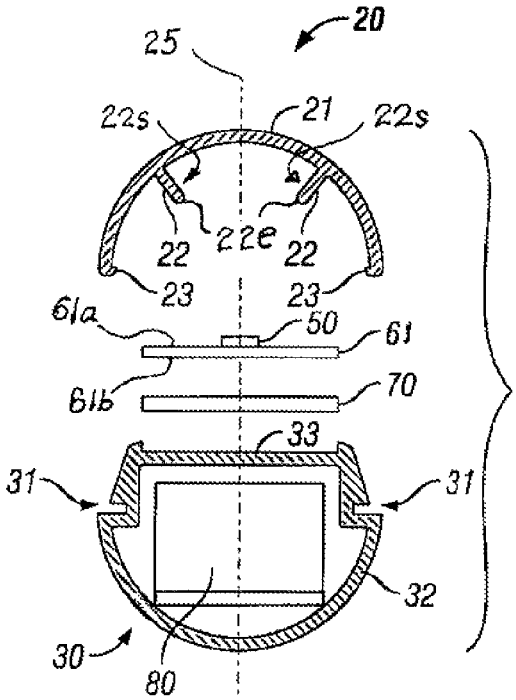
FIG. 3 is the same sectional view of FIG. 2 shown with elements separated.

As shown in FIG. 1, the metal support 30 has a first elongate securement structure and the clear lens 20 has a second elongate securement structure which is engaged with the first elongate securement structure thereby securing the clear lens to the metal support. This is accomplished wherein the first elongate securement structure includes parallel opposing grooves 31 as shown in FIG. 3, and which may run the full length of the metal support, and the second elongate securement structure includes parallel opposing fingers 23, also shown in FIG. 3 and which also may run the full length of the lens 20. The lens 20 is engaged with the metal support 30 when the fingers 23 are snapped into the grooves 31, and this may be accomplished by pressing the fingers 23 down over the metal support 30 until the fingers 23 find the grooves 31.

As shown in FIGS. 5 and 6, the circuit board 61 has first thermal pads 67 mounted on the component mounting surface 61*a* and second thermal pads 62 mounted on the thermal transfer surface 61*b*. Plated through holes 63 join the first 67 and second 62 thermal pads through board 61. Electrical components 68 are mounted onto electrical contacts 66 of the electrical circuit 60 and are in thermal contact with the first thermal pads 67. The second thermal pads 62 may be in direct contact with the metal support 30 as shown in FIG. 2. Alternately, a thermally conductive tape layer 70 may be positioned intimately between the second thermal pads 62 and the metal support 30 and this embodiment may provide improved thermal conduction from the components 68 to the metal support 30 which functions as a heat sink and radiator. Alternately, element 70 may be a thermally conductive paste.

FIG. 1 illustrates a side elevational view of the presently described apparatus, a lamp housing and operating lamp 10. A clear lens 20 covers a metal support 30 and end caps 40 are mounted on the ends of the lamp 10. As shown, electrodes 42 extend away from the lamp 10 in opposite directions.

FIG. 2 is a cross section of lamp 10 taken at line 2-2 and illustrates the interior construction. An electrical circuit board 61 has a component mounting surface 61*a* shown in FIG. 5, and in opposition thereto, a thermal transfer surface 61*b* shown in FIG. 4, the thermal transfer surface 61*b* is positioned, as shown in FIG. 2 for directing heat, by conduction, from the circuit board 61 to support 30.

The clear lens 20 is secured to the metal support 30 and a pair of ribs 22 (FIG. 3) are integral to the clear lens 20, and are in contact with the component mounting surface 61*a* of the circuit board 61 thereby urging the thermal transfer surface 61*b* into contact with surface 33 of metal support 30.

As shown in FIG. 1, the support 30 and the clear lens 20 may both be elongate, but other configurations are possible, such as circular, arcuate and rectangular. In the example shown in FIGS. 2 and 3, the metal support 30 is tubular but other configurations are possible as would be realized by a routine equipment designer.

As shown in FIG. 6, the operating lamp 10 has an electrical circuit 60 which includes electrodes 42, power supply 80 components and electrical conductors which interconnect these elements. As shown in FIG. 5, conductive etched copper traces 64*a* and 64*b* may be used to interconnect components on the circuit board 61. The traces 64*a* and 64*b* may be interconnected with electrodes 42 for interconnecting the electrical circuit 60 with an external power source, for instance a source of alternating current. The end caps 40 may have apertures 44 (FIG. 1) in them allowing the electrodes 42 to extend through caps 40 while allowing the end caps 40 to be removed without interfering with the electrical circuit 60.

As shown in FIG. 1, the support 30 has a first elongate securement structure and the clear lens 20 has a second elongate securement structure which is engaged with the first elongate securement structure thereby securing the clear lens 20 to the metal support. This is accomplished wherein the first elongate securement structure includes parallel opposing grooves 31 as shown in FIG. 3, and which may run the full length of the support 30, and the second elongate securement structure includes parallel opposing fingers 23, also shown in FIG. 3 and Which also may run the full length of the lens 20. The lens 20 is engaged with the support 30 when the fingers 23 are snapped into the grooves 31, and this may be accomplished by pressing the fingers 23 down over the metal support 30 until the fingers 23 find the grooves 31.

Figure 4:
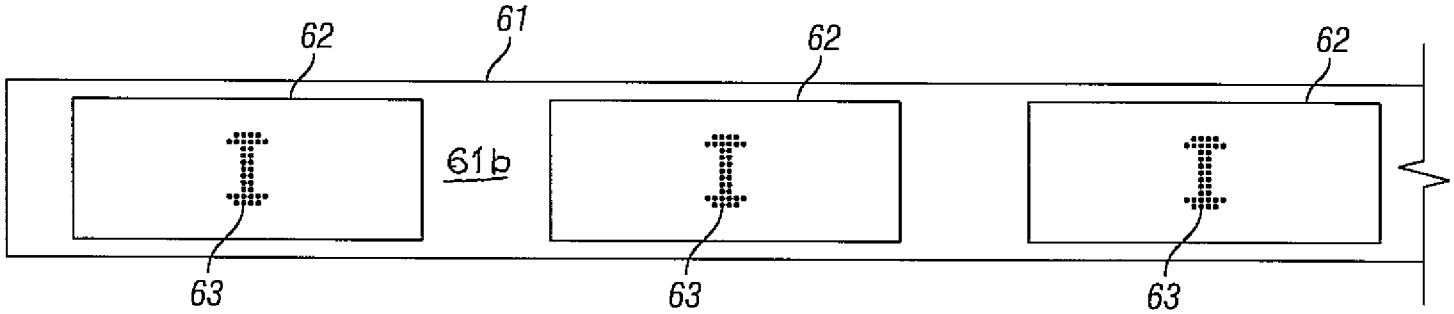
FIGS. 4 and 5 are representative partial plan views of the top and bottom surfaces of a circuit board thereof.

As shown in FIG. 4, the circuit board 61 has first thermal pads 67 mounted on the component mounting surface 61*a* and second thermal pads 62 mounted on the thermal transfer surface 61*b*. Plated through holes 63 join the first 67 and second 62 thermal pads through board 61. Electrical components 68 are mounted onto electrical contacts 66 of the electrical circuit 60 and are in thermal contact with the first thermal pads 67. The second thermal pads 62 may be in direct contact with the metal support 30 as shown in FIG. 2. Alternately, a thermally conductive tape layer 70 may be positioned intimately between the second thermal pads 62 and the metal support 30 and this embodiment may provide improved thermal conduction from the components 48 to the support 30 which functions as a heat sink and radiator. Alternately, element 70 may be a thermally conductive paste.

A number of embodiments have been described. Nevertheless, it will be understood that various modifications may be made without departing from the spirit and scope of this disclosure. Accordingly, other embodiments are within the scope of the following claims.

What is claimed is:

1. A lamp housing comprising:

a metal support;

an electrical circuit board having a component mounting surface with first thermal pads thereon, and in opposition therewith, a thermal transfer surface with second thermal pads thereon, pairs of the first and second thermal pads aligned in mutually corresponding positions on said surfaces of the circuit board, wherein each of the first thermal pads include two pad portions separated for inclusion by conductive strips;

a clear lens engaged with the metal support, the clear lens spaced apart from, and covering the electrical circuit board;

light emitting diodes (LEDs) mounted on the first thermal pads in positions for directing light emission therefrom toward the clear lens;

a pair of mutually convergent and spaced apart ribs, each of said ribs integral along one end thereof with the clear lens and terminating along an opposing free end;

the opposing free ends in contact with the component mounting surface for pressing the thermal transfer surface against the metal support; and the ribs configured and positioned on opposing sides of the LEDs to reflect light received directly from the LEDs toward the clear lens.

2. The apparatus of claim 1 wherein each mutually corresponding pair of first and second thermal pads is joined by a plurality of plated through holes in the electrical circuit board, the holes arranged in an "I" formation.

3. The apparatus of claim 1 wherein a convergence angle between the ribs is acute.

4. The apparatus of claim 3 wherein the convergence angle between the ribs is approximately 72°.

* * * * *